US008677644B1

(12) United States Patent
Main

(10) Patent No.: US 8,677,644 B1
(45) Date of Patent: Mar. 25, 2014

(54) LOCKING WEDGE GAGE TOOL ASSEMBLY FOR ASSAULT WEAPON

(75) Inventor: Richard E. Main, Fredericksburg, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 177 days.

(21) Appl. No.: 13/317,036

(22) Filed: Sep. 28, 2011

(51) Int. Cl.
*G01B 5/12* (2006.01)
*G01B 3/26* (2006.01)

(52) U.S. Cl.
USPC ..... 33/506; 33/613; 33/542.1

(58) Field of Classification Search
USPC ..... 33/613, 1 BB, 506, 542, 545, 542.1
See application file for complete search history.

(56) References Cited

U.S. PATENT DOCUMENTS 2,274,275 A * 2/1942 Phillips ..... 33/542
2,581,473 A * 1/1952 Eisele ..... 33/501.4
2,721,392 A * 10/1955 Barrett ..... 33/542.1
3,848,339 A * 11/1974 Strasbaugh ..... 33/507
4,476,634 A * 10/1984 Yamamoto et al. ..... 33/501.4
4,606,129 A * 8/1986 Barrowman et al. ..... 33/501.09
4,710,077 A 12/1987 Ramunas ..... 409/232
5,482,417 A 1/1996 Erickson ..... 411/306
5,548,901 A * 8/1996 Isler ..... 33/542.1
6,490,805 B1 * 12/2002 Forschler et al. ..... 33/542
6,718,645 B2 * 4/2004 Berger ..... 33/506
6,773,210 B2 8/2004 Erickson ..... 407/102
6,792,691 B2 * 9/2004 Genal et al. ..... 33/833
7,581,330 B1 * 9/2009 Redmond ..... 33/611
7,913,411 B2 * 3/2011 Klepp ..... 33/544.5

* cited by examiner

*Primary Examiner* — Christopher Fulton
(74) *Attorney, Agent, or Firm* — Gerhard W. Thielman, Esq.

(57) ABSTRACT

An assault weapon locking wedge gage tool assembly includes a main body portion; at least one limit stop plate assembly connected to the main body portion; an interchangeable locking wedge stop connected to the limit stop plate assembly and configured to engage a locking wedge of a weapon; a moveable gage ball plunger positioned in the limit stop plate assembly and contacting the locking wedge; at least one position indicator operatively connected to the moveable gage ball plunger, wherein the position indicator displays a relative position of the locking wedge with respect to a known position of the locking wedge stop. The assembly includes an interchangeable ring configured around the main body portion.

12 Claims, 9 Drawing Sheets

SECTION C-C

SECTION A-A

SECTION B-B

SECTION D-D

DETAIL E

SECTION F-F

LOCKING WEDGE GAGE TOOL ASSEMBLY FOR ASSAULT WEAPON

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The embodiments herein generally relate to weapons systems, and, more particularly, to shoulder-launched multipurpose assault weapon (SMAW) systems and components.

As the name suggests, a SMAW system is a shoulder-launched rocket weapon system allowing for portability for its use. The SMAW launcher has a quick twist-lock interface allowing ammunition to be locked into the launcher with one quick push-and-twist motion. This unique interface presents a complex multidimensional measuring problem for the launcher assembly that includes a set of raised locking wedges inside the launcher, which prevent inadvertent and unintentional discharge of the weapon. The location of these locking wedges is critical to the reliability, function, and safety of these launchers.

Adding to this problem is the launch tube, which is a sub-part of the launcher's assembly, and has the same inspection problem, but with a slightly different dimension requirement, because at this point the launcher's aft ring has not been installed. Additionally, the current in-service launchers have two different versions of the locking wedge configuration. Moreover, the locking wedges have to be measured individually.

Because the location of the locking wedges is very critical to the reliability, function, and safety of the launchers, it has become commonplace to incorporate a phantom or imaginary inspection tool technique to maintain proper location of the locking wedges. This means there is an imaginary circle (e.g., approximately 10 mm in diameter) drawn at the front center of the locking wedge. The locations of the locking wedges are then measured from this 10 mm inspection tool to the aft-end of the launcher. This technique allows the center of the locking wedges to be held to a specific distance in from the aft-end of the launch tube (or launcher), regardless of the angle manufactured on the front edge of the locking wedges.

This inspection problem then splits into two different categories, and at each category the conventional techniques are different and present their own set of unique problems. First, at the sub-part level (described in further detail below with reference to the launch tube production); and second when building/rebuilding launchers (described in further detail below with reference to the building/rebuilding launchers).

Launch Tube Production:

This level of inspection has regularly been performed with a very expensive coordinate measuring machine (CMM) and a complicated inspection process. This presents some problems. First, the dimensions are internal and because of the length of the launch tube, a user needs a very large and expensive programmable CMM, which increases inspection costs. Second, this process relies on the CMM using a small and short angle as a starting point. Because it is difficult for these machines to pick up small and short angles, this stretches the accuracy limits of these machines, which results in a quality assurance problem. When the launch tubes are removed from molds, the internal and external dimensions are all achieved by the mold except the overall length. All internal parts of the launch tube such-as the locking wedges and the contact points are attached to the internal mandrel before the resin is injected into the mold.

When the tube is first removed from the mold, there is excess material on both the aft-end and the muzzle end of the launch tube. The unfinished launch tubes are then typically taken to a machine shop where they are put into a lathe to make a rough cut squaring up the aft-end. No dimensional tolerance is held at this point. All that is necessary is to square up the aft-end so an inspector has a square edge to work from for the following stages.

The tube is then sent to a gage lab where it is set up in a CMM to find the rough-cut length. A nominal dimension is subtracted from the rough-cut length found by the CMM, which provides the inspector with a known amount of material that has to be removed. The tube is then sent back to the machine shop with an exact amount of material that has to be removed. The material is removed from the aft-end, and the tube is turned around in the lathe and then the muzzle end is cut to the total overall length. At this point, it is assumed that the finished product is a good part. However, the problem is that there is a lot of room for human-error in this process and a lot of reason to question the recorded location of the locking wedges upon completion.

The quality of this product relies significantly on how well each process is performed, as well as how accurately the locking wedges are installed on the internal mold/mandrel before the resin is injected. Also, a CMM typically cannot accurately find the required angles, and the fact that molded parts are not perfectly round or flat, makes the entire procedure extremely subjective and error-prone. Finally, nowhere in this procedure is the position of the locking wedges actually measured. Thus, the conclusion reached is that the finished parts are sufficiently manufactured to use with the launchers. However, this cannot be verified with certainty.

Building/Rebuilding Launchers:

The SMAW special weapons technicians have been using various techniques over the years to measure this interface. According to a first method, one assumes the launch tube and aft-ring are manufactured and assembled correctly. According to a second method, a technique is implemented for using an old encasement with lines penciled on the outer surface identifying where the locking wedges are. Then, masking tape is applied to the outside of the launcher, and some lines are drawn on the outside of the launcher depicting where the locking wedges are on the inside. Next, the encasement is inserted with the pencil lines into the launcher. Thereafter, the encasement is rotated until it locks to see if the lines match up. According to a third method, a millijoule meter is installed to check if the alignment is correct.

Unfortunately, the conventional techniques require this interface to be within 0.2 mm (±0.0038 inch). Moreover, none of the above-mentioned procedures actually measure the locking wedge position individually, and accordingly all of these procedures are nothing more than an educated guess. Therefore, it is desirable to develop an improved SMAW assembly inspection tool and procedure that is readily adaptable in current weapon systems at reduced cost and complexity.

SUMMARY

Conventional gage tools yield disadvantages addressed by various exemplary embodiments of the present invention. In view of the foregoing, an embodiment herein provides an assault weapon locking wedge gage tool assembly comprising a main body portion; at least one limit stop plate assembly connected to the main body portion; an interchangeable locking wedge stop connected to the at least one limit stop plate assembly and configured to engage a locking wedge of a weapon; a moveable gage ball plunger positioned in the at least one limit stop plate assembly and contacting the locking wedge; at least one position indicator operatively connected to the moveable gage ball plunger, wherein the at least one position indicator displays a relative position of the locking wedge with respect to a known position of the locking wedge stop.

The assembly may comprise of an interchangeable ring configured around the main body portion. At least one position indicator may measure a depth of the locking wedge inside the weapon within an accuracy range of plus-or-minus five ten-thousandths (±0.0005) of an inch. The interchangeable locking wedge stop may comprise a plurality of configurations, wherein a first configuration is wider than a second configuration. The moveable gage ball plunger may be spring actuated and moves upon contacting the locking wedge. At least one position indicator may comprise two position indicators placed 180° (degrees) apart from one another. The assembly may further comprise a moveable socket connected to the at least one limit stop plate assembly, wherein the moveable socket is operatively connected to each of the at least one position indicator and the moveable gage ball plunger. At least one limit stop plate assembly may be formed of a mechanically harder material than the main body portion.

Another embodiment herein provides a portable inspection system comprising a weapon comprising a launch tube comprising at least one locking wedge configured therein; and a locking wedge gage tool assembly that inspects a position of the locking wedge inside the launch tube, wherein the assembly comprises a main body portion comprising an inner core and an outer surface; a handle operatively connected to the main body portion, wherein the handle permits rotation of the main body portion inside the launch tube; a pair of diametrically opposed limit stop plate assemblies connected to the main body portion, wherein each limit stop plate assembly comprises an outer surface facing away from the inner core and substantially matching a contour of the outer surface of the main body portion; an interchangeable locking wedge stop connected to the each limit stop plate assembly and configured to engage the locking wedge inside the launch tube and prevent further rotation of the main body portion inside the launch tube upon contacting the locking wedge; a moveable gage ball plunger positioned through the each limit stop plate assembly and contacting the locking wedge; and a pair of position indicators operatively connected to the moveable gage ball plunger, wherein the pair of position indicators measure a position of the locking wedge within the launch tube.

The system may further comprise an interchangeable ring configured around the main body portion. The pair of position indicators may comprise a first position indicator and a second position indicator, wherein the second position indicator takes measurements more precisely than the first position indicator. The interchangeable locking wedge stop may comprise a plurality of configurations, wherein a first configuration is narrower than a second configuration. The moveable gage ball plunger may be spring actuated and moves upon contacting the locking wedge. The first position indicator is diametrically opposed to the second position indicator.

The system may further comprise a moveable socket connected to the each limit stop plate assembly, wherein the moveable socket is operatively connected to each of the pair of position indicators and the moveable gage ball plunger. The each limit stop plate assembly may be formed of a mechanically harder material than the main body portion.

Another embodiment herein provides a method of inspection comprising providing a weapon comprising a launch tube comprising at least one locking wedge configured therein; inspecting the locking wedge inside the launch tube using an gage tool assembly that comprises a locking wedge stop, a moveable gage ball plunger, and a pair of position indicators that are operatively connected to the moveable gage ball plunger; rotating the gage tool assembly inside the launch tube, wherein the rotating causes the moveable gage ball plunger to move along a tapered side of the locking wedge; terminating rotation of the gage tool assembly upon an edge of the locking wedge contacting the locking wedge stop; and measuring a position of the locking wedge within the launch tube using the pair of position indicators. The method may further comprise measuring the launch tube. The pair of position indicators may comprise a first position indicator and a second position indicator, wherein the second position indicator takes measurements more precisely than the first position indicator. The method may further comprise interchanging a plurality of configurations of the locking wedge stop.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

Figure 1:
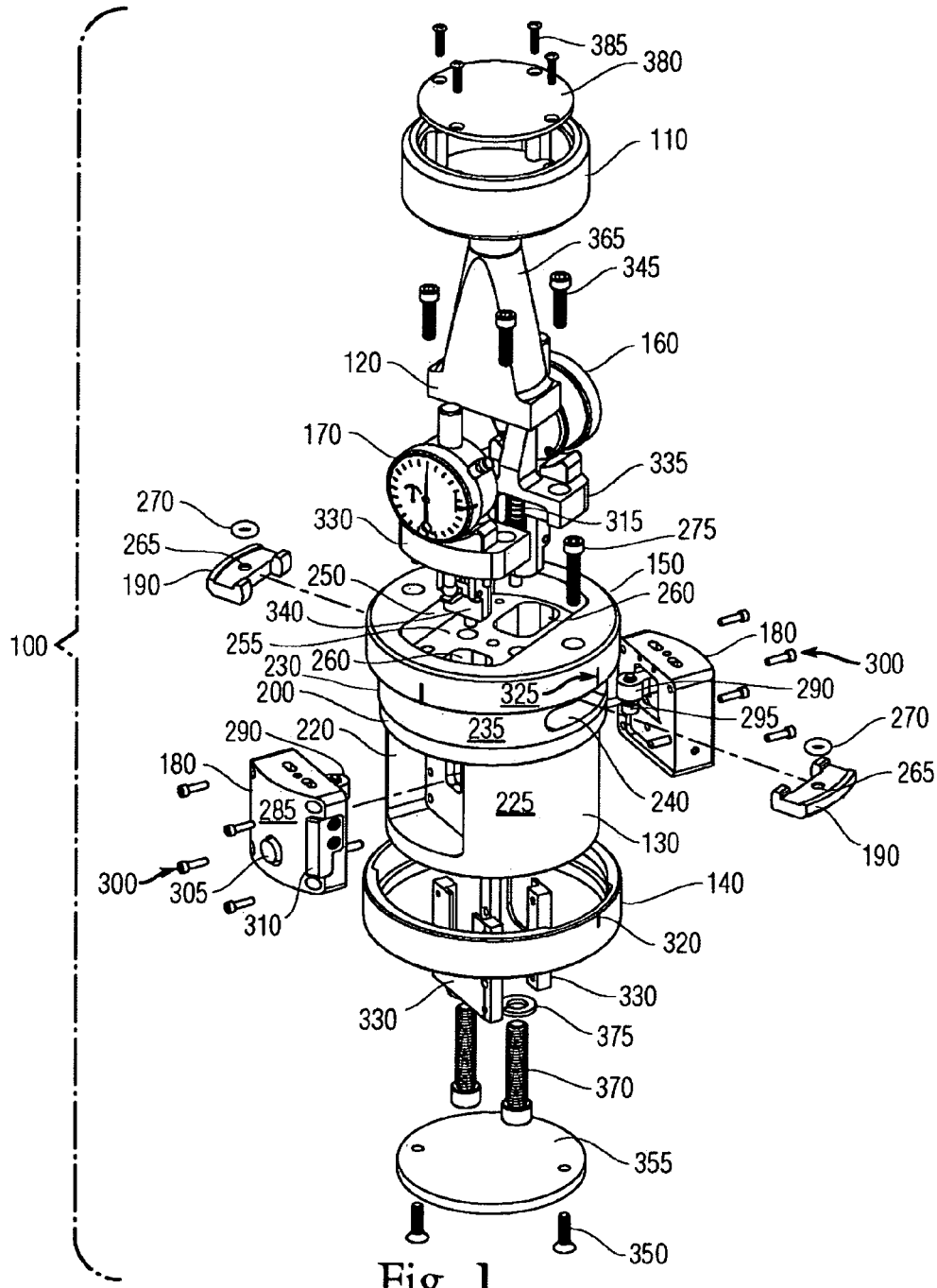
FIG. 1 illustrates an exploded view of a SMAW locking wedge gage tool assembly according to an embodiment herein.
Figure 2:
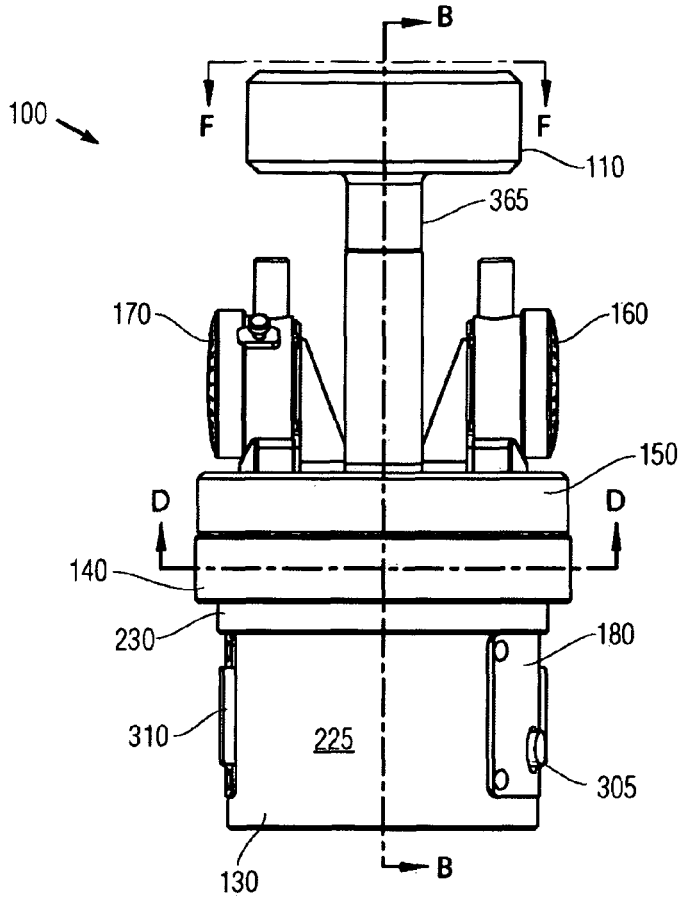
FIG. 2 illustrates a side view of an assembled SMAW locking wedge gage tool assembly according to an embodiment herein.
Figure 4:
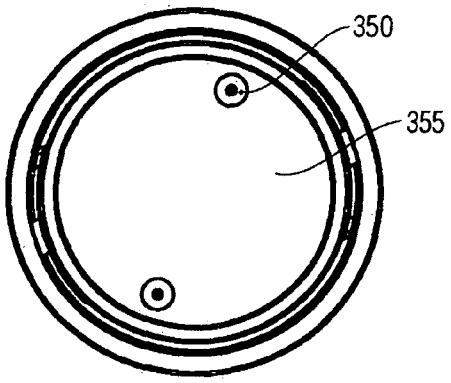
FIG. 4 illustrates a bottom view of the SMAW locking wedge gage tool assembly of FIG. 2.
Figure 5:
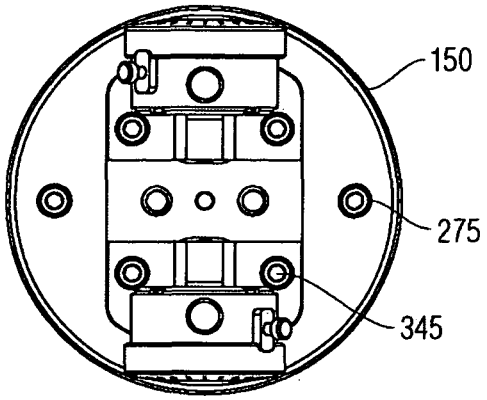
FIG. 5 illustrates a top view of the SMAW locking wedge gage tool assembly of FIG. 3 with the handle removed.
Figure 3:
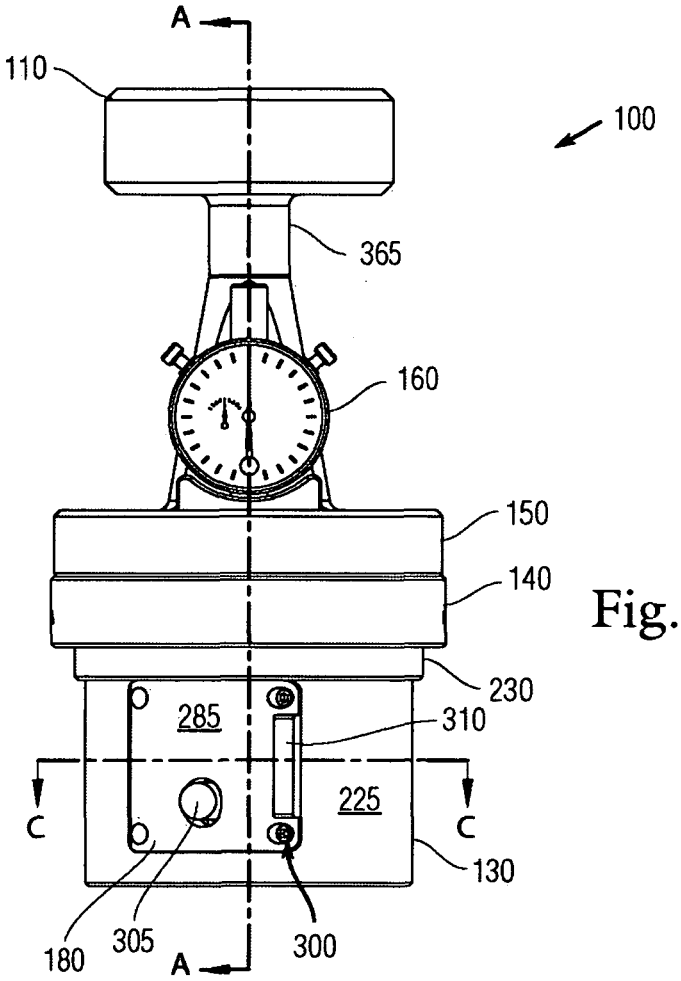
FIG. 3 illustrates a front view of the SMAW locking wedge gage tool assembly of FIG. 2.
Figure 6:
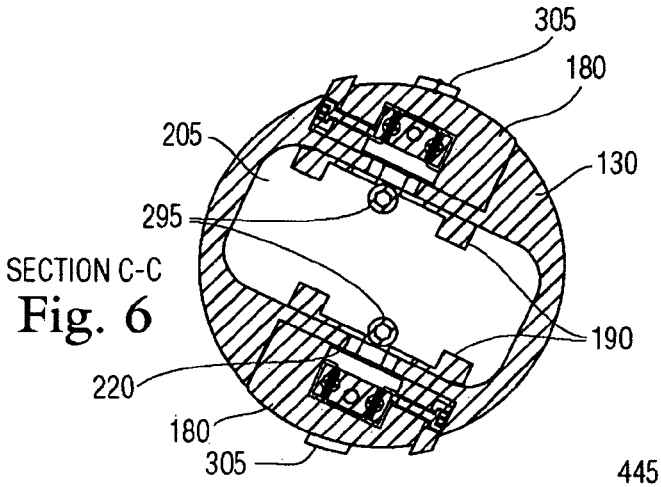
FIG. 6 illustrates a cross-sectional view of the SMAW locking wedge gage tool assembly cut along line C-C of FIG. 3.

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

The embodiments herein provide a tool and procedure to measure the depth of the locking wedges inside a SMAW within an accuracy range of plus-or-minus five ten-thousandths (±0.0005) of an inch while also decreasing production cost and time during manufacturing, and eliminating a long-term maintenance issue. Referring now to the drawings, and more particularly to FIGS. 1 through 15, where similar reference characters denote corresponding features consistently throughout the figures, there are shown preferred embodiments.

Figure 13:
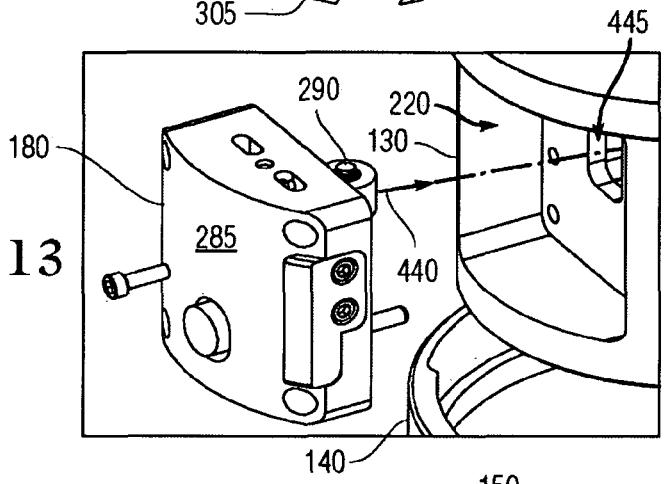
FIG. 13 is a detail isometric exploded view of the stop plate assembly insertable into the main body.
Figure 14:
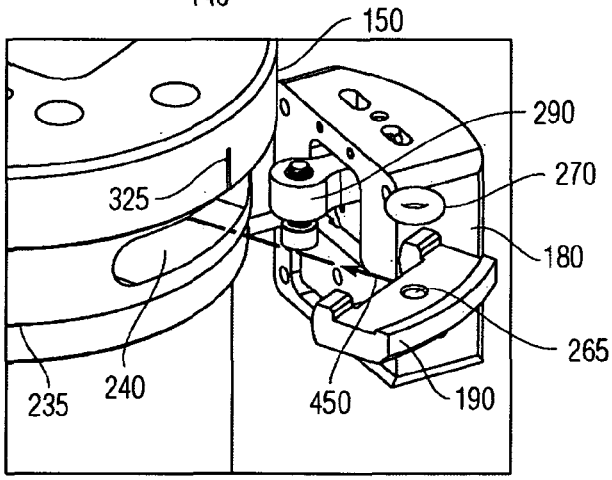
FIG. 14 is a detail isometric exploded view of the clamp ring plate insertable into the main body.
Figure 7:
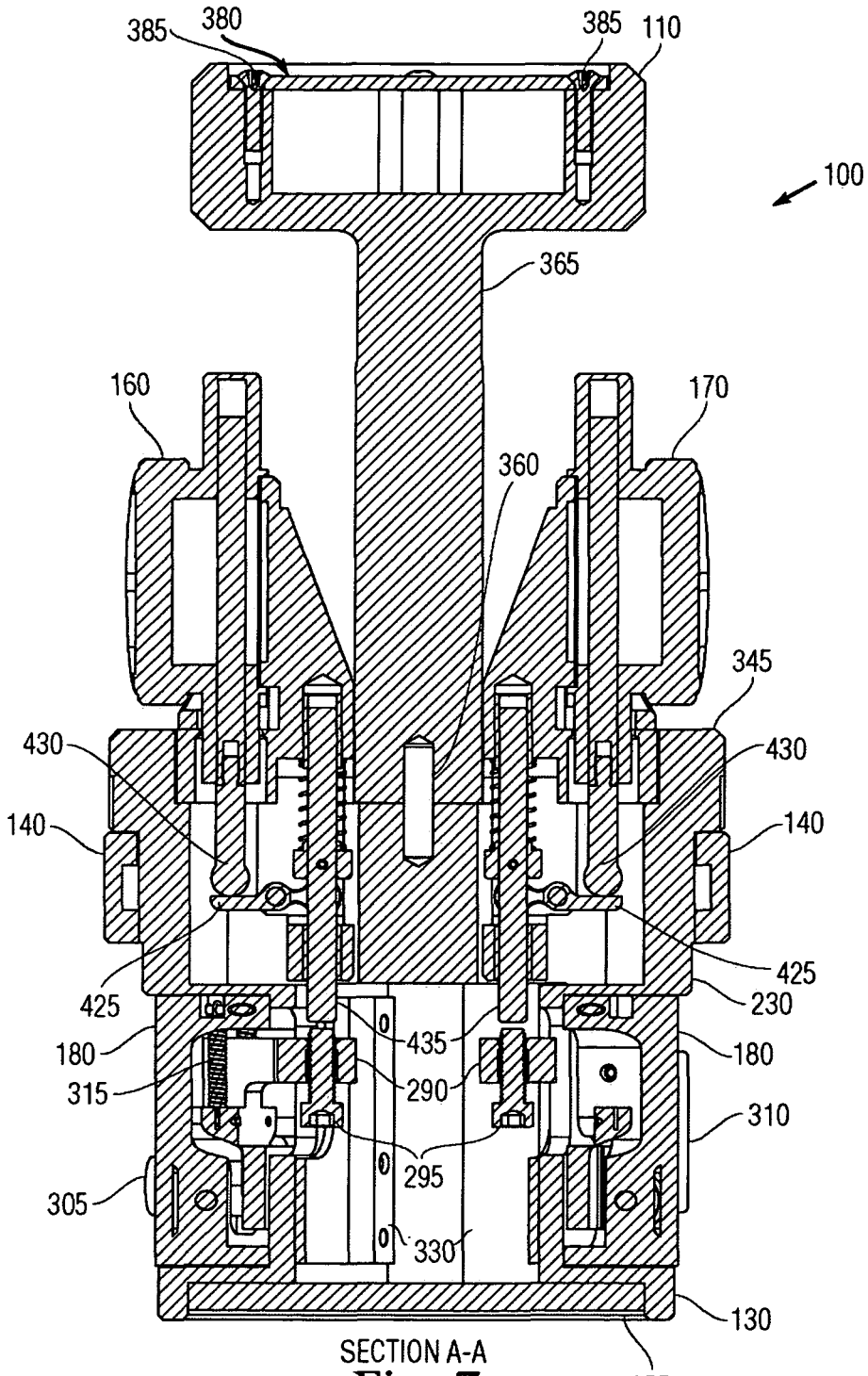
FIG. 7 illustrates a cross-sectional view of the SMAW locking wedge gage tool assembly cut along line A-A of FIG. 3.
Figure 8:
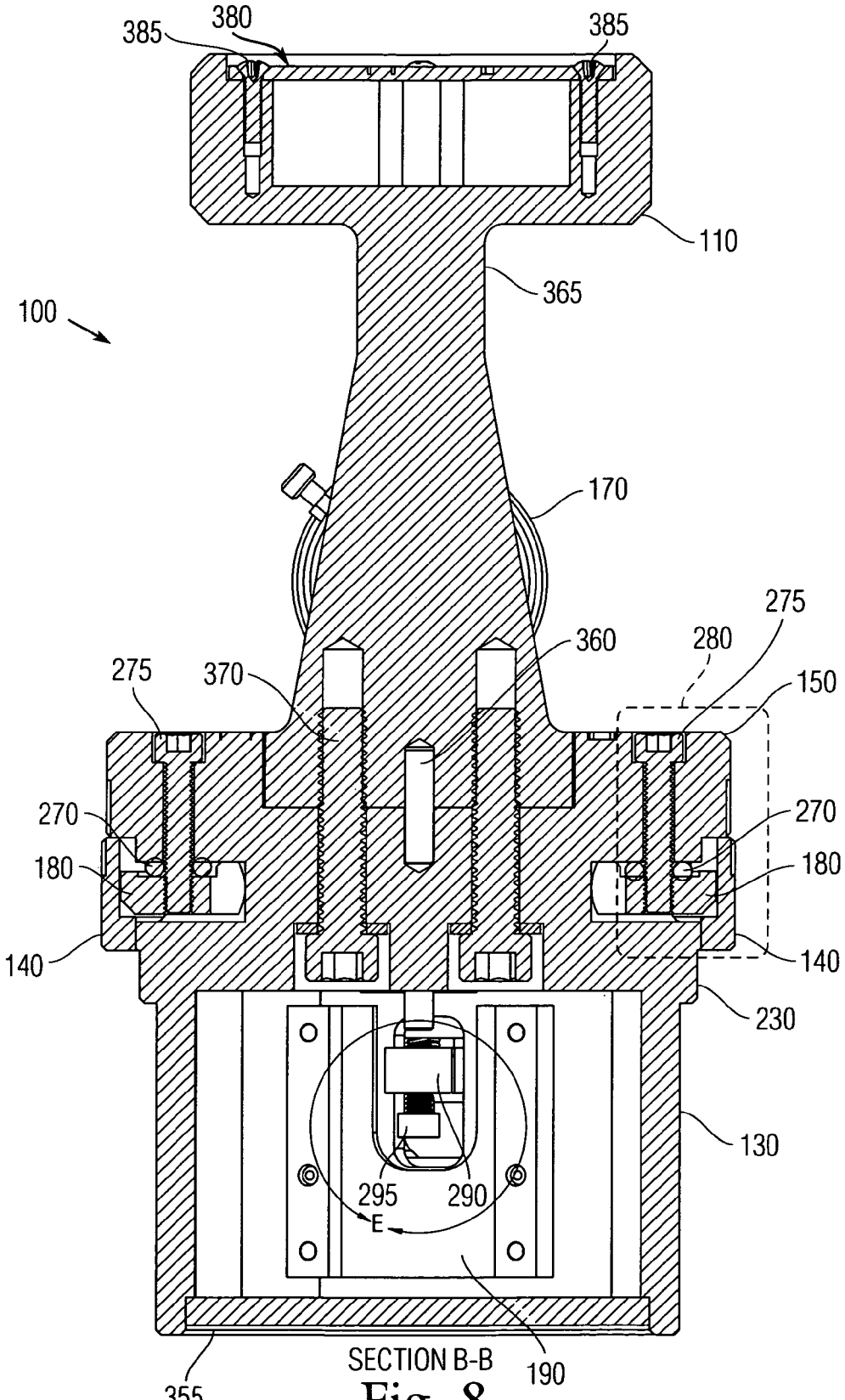
FIG. 8 illustrates a cross-sectional view of the SMAW locking wedge gage tool assembly cut along line B-B of FIG. 2.
Figure 9:
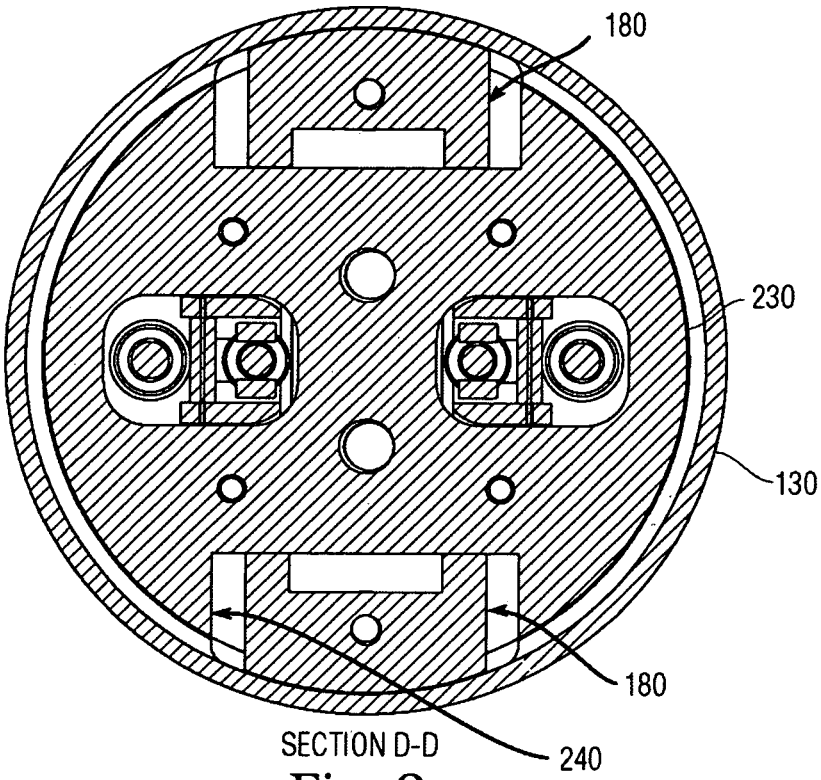
FIG. 9 illustrates a cross-sectional view of the SMAW locking wedge gage tool assembly cut along line D-D of FIG. 2.
Figure 10:
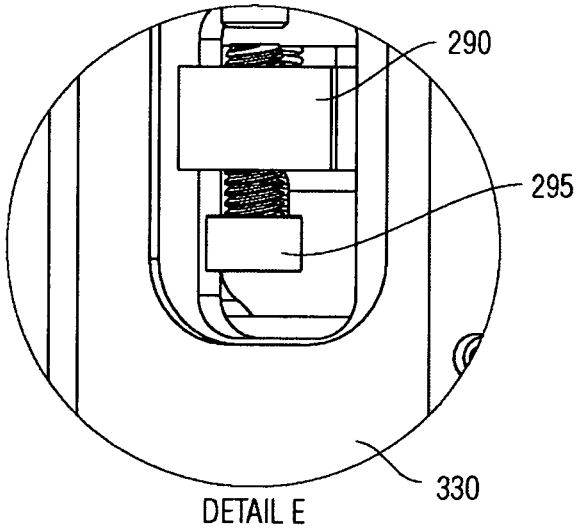
FIG. 10 illustrates a magnified view of encircled area E of FIG. 8.

As shown in FIGS. 1 through 15, the embodiments herein provide a SMAW locking wedge gage tool assembly 100, comprising a handle 110, a gage mount 120 and a main body 130. Additional components described in detail herein include a ring stop 140, a base collar 150, coarse and fine gages 160 and 170, and a clamp plate 190. The exemplary gage tool assembly 100 overcomes all of the previously described inspection problems at all of the different production stages of the launch tube 200; i.e., launch tube production, launcher builds, and rebuilds. FIGS. 1 through 11 along with FIGS. 13 and 14 illustrate various views of the SMAW locking wedge gage tool assembly 100 according to an embodiment herein. FIG. 1 presents an isometric exploded view of the gage tool assembly 100 that includes the main body 130, which is substantially cylindrically configured. The main body 130 has an inner hollow core 205 on its inside and a pair of diametrically opposed cuts 220 configured on the outer surface 225 of the main body 130.

Moreover, the main body 130 includes a collar 230 disposed around the main body 130 and on top of the cuts 220. The collar 230 is diametrically larger than the main body 130. The upper portion 235 of the collar 230 includes a pair of diametrically opposed cut outs 240. Configured on top of the upper portion 235 of the collar 230 is the gage base 150, which is also substantially cylindrically configured and is diametrically larger than the main body 130 and collar 230. The gage base 150 includes a center core 250 that exposes its top surface 255 of the upper portion 235 of the collar 230 of the main body 130 including a plurality of holes 260 that are configured into the upper portion 235 and extend to the inner hollow core 205.

A pair of clamp ring plates 190 are dimensioned and configured to fit into the respective cut outs 240 configured in the upper portion 235 of the collar 230. Each plate 190 includes an aperture 265 that aligns with an O-ring 270, which further accommodates a fastening mechanism 275 (e.g., screw, bolt, etc.) to securely fasten the ring stop 140 to the underside of gage base collar 150 of main body 130. Furthermore, the combination of plate 190, O-ring 270, and fastening mechanism 275 create a spring-loaded cam mechanism 280 (in FIG. 8) that enables the stop rings 140 be changed with just ½ a turn of fastening mechanism 275. A pair of diametrically opposed limit stop plate assemblies 180 are each dimensioned and configured to fit into the respective cuts 220 of the main body 130. The outer surface 285 of each limit stop plate assembly 180 faces away from the inner core of the main body 130 and is contoured to be concentric with but slightly larger than the curvature of outer surface 225 of the main body 130.

A moveable socket 290 and an adjusting mechanism 295 (e.g., screw, bolt, etc.) engage each limit stop plate assembly 180 and extend internally to inner core of the main body 130. Adjusting mechanism 295 enables calibration of gage tool assembly 100 to be simplistic and precise. Setting the gage ball plunger 305 to the desired nominal depth position, and then rotating the adjusting mechanism 295 until the indicators 160 and 170 reach the zero position calibrates gage tool assembly 100. Additionally, a plurality of fastening mechanisms 300 (e.g., screw, bolt, etc.) and clamp plates 190 are used to secure the limit stop plate assemblies 180 into place in the cuts 220 and to the main body 130. Each limit stop plate assembly 180 includes a moveable gage ball plunger 305 and an interchangeable wedge stop 310. The wedge stop 310 may be configured in either a relatively narrow or wide configuration. The gage ball plunger 305 is actuated using a spring 315.

The interchangeable wedge stops 310 enable the user to gage either wide or narrow locking wedge configurations. By configuring the gage tool assembly 100 with a first type of wedge stops 310, older launchers or blank launch tubes with the narrow locking wedge configuration can be measured. By configuring the assembly 100 with a second type of wedge stops 310, newer launchers or blank launch tubes with the wide locking wedge configuration can be measured.

An interchangeable stop ring 140 is positioned around the collar 230 such that is substantially aligns with the gage base 150. During installation, alignment markers 320 on the top of ring stop 140 are used to correspond with alignment markers 325 on the gage base 150 to ensure proper seating of the stop ring 140 around the collar 230 and adjacent to the gage base 150.

The assembly 100 accommodates different configurations of the stop ring 140, wherein by changing the configuration of the stop ring 140 on the assembly 100, the user is capable of measuring the proper locking wedge position on any of the following three scenarios: A first type of stop ring 140 is used when measuring any current launcher with an aft ring (not shown) installed. A second type of stop ring 140 is used when measuring any blank launch tube (sub-part), which will also be the assembly 100 set up when measuring any launcher with the aft ring missing or removed for rework. A third type of stop ring 140 is used to measure any older launcher with an aft ring installed.

A pair of clamp plates 330 is positioned inside the main body 130 to retain the limit stop plate assemblies 180 to the main body 130 from within the main body 130. The clamp plates 330 are substantially U-shaped, although other configurations are possible, and the embodiments herein are not limited to a particular geometric configuration for the clamp plates 330 or any other feature or component of the assembly 100.

A pair of dial indicators (position gages) 160 and 170 is positioned on top of the gage base 150, more particularly, each being seated on a block 335 that is dimensioned and configured to fit inside the center core of the gage base 150. An anchor 340 is affixed on the underside of each block 335 such that the anchors 340 are dimensioned and configured to fit within the holes 260 that are configured into the upper portion 235 of the main body 130 and extending to the inner core 205 of the main body 130, enabling contact with adjusting mechanism 295. Additionally, a plurality of fastening mechanisms 345 (e.g., screws, bolts, etc.) are used to secure the blocks 335 to the main body 130 from above. Furthermore, a plurality of fastening mechanisms 350 (e.g., screws, bolts, etc.) are used to secure a substantially cylindrically configured bottom plate 355 to the underside of the main body 130.

The upright member 120 is positioned in between the pair of dial indicators 160 and 170. A dowel pin 360 is used to center upright member 230 within main body cavity 350. The upright member 120 tapers upward into a neck portion 365, which connects to a handle 110 that facilitates a user to properly grip and rotate the assembly 100 upon full assemblage of the various components. A plurality of fastening mechanisms 370 (e.g., screws, bolts, etc.) with corresponding load distributors 375 (e.g., washers, etc.) are used to secure the handle 110 to main body 130 from below. A handle cap 380 is positioned on top of the handle 110 and is securely fastened thereto using a plurality of fastening mechanisms 385 (e.g., screws, bolts, etc.).

The SMAW locking wedge gage tool assembly 100 successfully resolves all of the inspection problems on both locking wedge versions (wide or narrow). The assembly 100 simulates the above-mentioned phantom or imaginary inspection tool technique by incorporating a 10 mm inspection tool into a physical part of the gage tool assembly 100, called the gage ball plunger 305. With reference to FIGS. 1 through 14, when the locking wedge 390 and gage tool assembly 100 is inserted into the aft-end 395 of the launch tube 200, the assembly 100 is then rotated in a clockwise motion until the edge 400 of the launch tube's locking wedges 390 comes in contact with the locking wedge stops 310 of the assembly 100. This is called the gage tool's locked position shown by the solid polygon 415 in FIG. 12. The motion of the locking wedge 390 is denoted by line 405 in FIG. 12.

Figure 12:
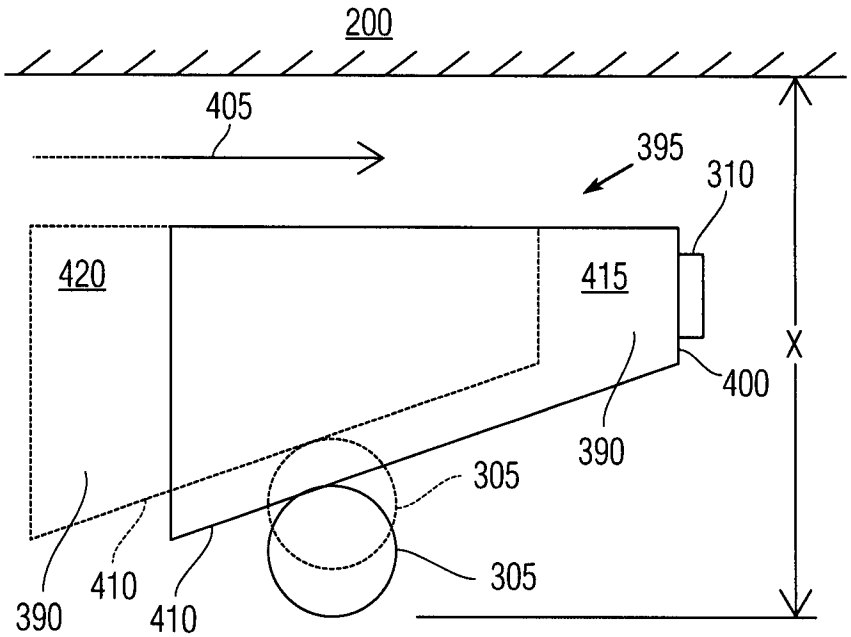
FIG. 12 is a system diagram according to an embodiment herein.
Figure 11:
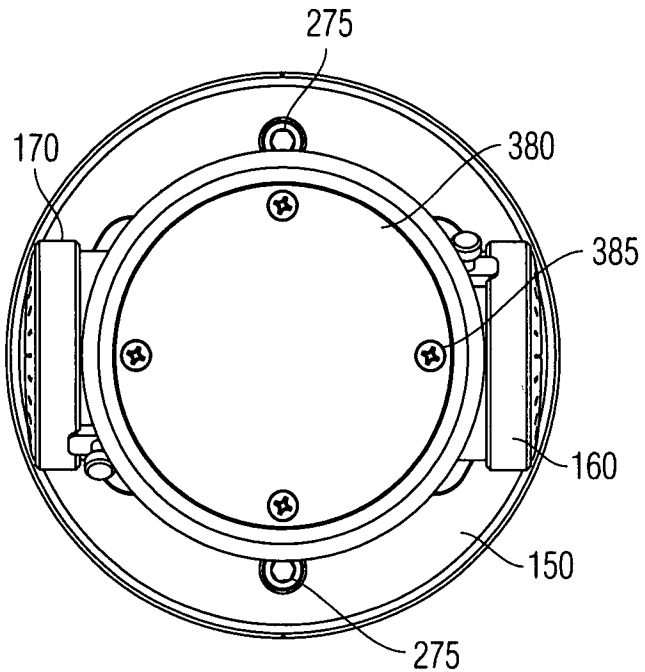
FIG. 11 illustrates a top view of the SMAW locking wedge gage tool assembly viewed along line F-F of FIG. 2.

Before the assembly 100 reaches this locked position, the tapered edge 410 of the locking wedges 390 contacts the spring-loaded 10 mm gage ball plunger 305 first, shown by the dashed polygon 420 in FIG. 12. As the gage tool assembly 100 continues to rotate, the gage ball plunger 305 moves up the locking wedge 390 until the gage tool assembly 100 reaches the locked position, shown by the solid polygon in FIG. 12.

In this position, the 10 mm gage ball plunger 305 is at the proper distance in from the edge 400 of the locking wedge 390. In other words, in FIG. 12, the dashed polygon shows the starting point when the locking wedge 390 first contacts the gage ball plunger 305 (e.g., dashed circle in FIG. 12), and the solid polygon shows the locked position of the locking wedge 390 and the solid circle shows the resting point of the gage ball plunger 305. The indicator assemblies are directly connected to any movement (e.g., displacement) the gage ball plungers 305 make, and at this point all that is necessary from the user is to read (span X) the dial indicator 160 and 170.

As shown in FIG. 1, the limit stop plate assemblies 180 are raised slightly higher than the main body part 1 of the assembly 100. This enables the gage tool assembly 100 the ability to float inside the launch tube 200, while staying in proper contact with the locking wedges 390. The assembly 100 makes it possible to gage any launch tube 200 regardless of any concentricity, roundness, and location manufacturing errors on the launch tubes 200 and also the limit stop plate assemblies 180 are made of a material that is mechanically harder than the material (e.g., aluminum) used for the main body 130, thereby creating a long-term wear surface. For accuracy purposes, the gage tool assembly 100 includes two different dial indicators 160 and 170, which are positioned 180° (degrees) apart and are diametrically opposed to one another. The first indicator 160 is a coarse indicator, provides a coarse measurement, and has a longer range of travel. The second indictor 170 is a fine indicator, offers a more precise reading, but has a shorter range of travel than the first indicator 160.

To eliminate confusion, when reading and understanding the dial indicators 160 and 170, these read zero when the locking wedge 390 is at the center of its tolerance zone, or the nominal depth position. Also any position the locking wedge 390 is in plus-or-minus of the nominal position will read exactly the same on the dial indicators 160 and 170, which is accomplished by using a pivot mechanism 425 that operatively connects the measuring component 430 of the dial indicators 160 and 170 to a translatable link 435 that abuts the adjusting mechanism 295 positioned in the moveable socket 290, which moves upon actuation of the spring-loaded gage ball plunger 305. The gage ball plunger 305 moves upon contacting the tapered end 410 of the locking wedge 390. FIGS. 2-11 illustrate plan and elevation views of the assembly 100 and select components, whereas FIG. 12 provides a motion alignment diagram. FIGS. 13 and 14 provide detail isometric exploded views of the stop and clamp plates 180 and 190 regarding insertion into the main body 130. In particular, FIG. 13 shows the stop plate 180 traveling in direction 340 into a corresponding cut 220 on an angular periphery along the surface 225 of the main body 130. As the stop plate 180 is inserted into the cut 220, the socket 290 enters an internal cavity 345. Additionally, FIG. 14 shows the clamp plate 190 traveling in direction 350 into a corresponding cut 240 on the annular periphery of the collar 230. The assembly 100 includes two stop plates 180 inserted into corresponding cuts 220 on opposing sides of the periphery separated by 180° from each other. Similarly, the assembly 100 includes two clamp plates 190 inserted into corresponding cuts 240 on opposing sides of the periphery separated by 180° from each other and by 90° from the stop plates 180 in their cuts 220.

The assembly 100 is capable of overcoming all of the various different inspection scenarios. By interchanging different parts (e.g., stop ring 140 and locking wedge stops 310) on the assembly 100, it can be quickly set-up to successfully gage the locking wedge position on different requirements thereby making the assembly 100 capable of:

(a) measuring any new-production blank launch tube (sub-part) with the wider locking wedge configuration, (b) measuring any older launch tube (sub-part) with the narrow locking wedge configuration, (c) measuring any in-service launcher with either the older narrow locking wedge configuration, (d) measuring any in-service launcher with the new wider locking wedge configuration, (e) measuring any launcher with either (wide or narrow) locking wedge configuration accurately after the aft ring has been removed as a sub-part, such as any launcher being refitted for a new aft ring, and (f) checking the position of the locking wedges 390 in a SMAW launcher test stand (not shown) also.

The accuracy of the gage tool assembly 100 is linked to the following elements:

(A) How accurate the dial indicators 160 and 170 are themselves, and what their readout graduations are. According to the embodiments herein, the dial indicators 160 and 170 are extremely precision tools manufactured to a jeweled quality. The coarse indicator 160 with the longer range of travel is graduated to 0.0005 inch, and is manufactured/jeweled to a much higher requirement. The fine indicator 170 is graduated to 0.0001 inch, and is manufactured or jeweled to a much higher requirement also.

(B) The manufacturing quality of all the gage tool parts and assemblies suggests that some uniquely shaped or difficult parts are to be manufactured, and economically it would not be practical on a low production item to over tolerance all these uniquely shaped parts. Therefore calibration adjustments are built into the configurations.

(C) The indicator assembly setup are all significant assembly operations in retrieving an accurate reading from the dial indicators 160 and 170. These three major requirements control a one-to-one ratio of movement through the pivot mechanism 425, and compensate for any manufacturing anomalies with shims.

Figure 15:
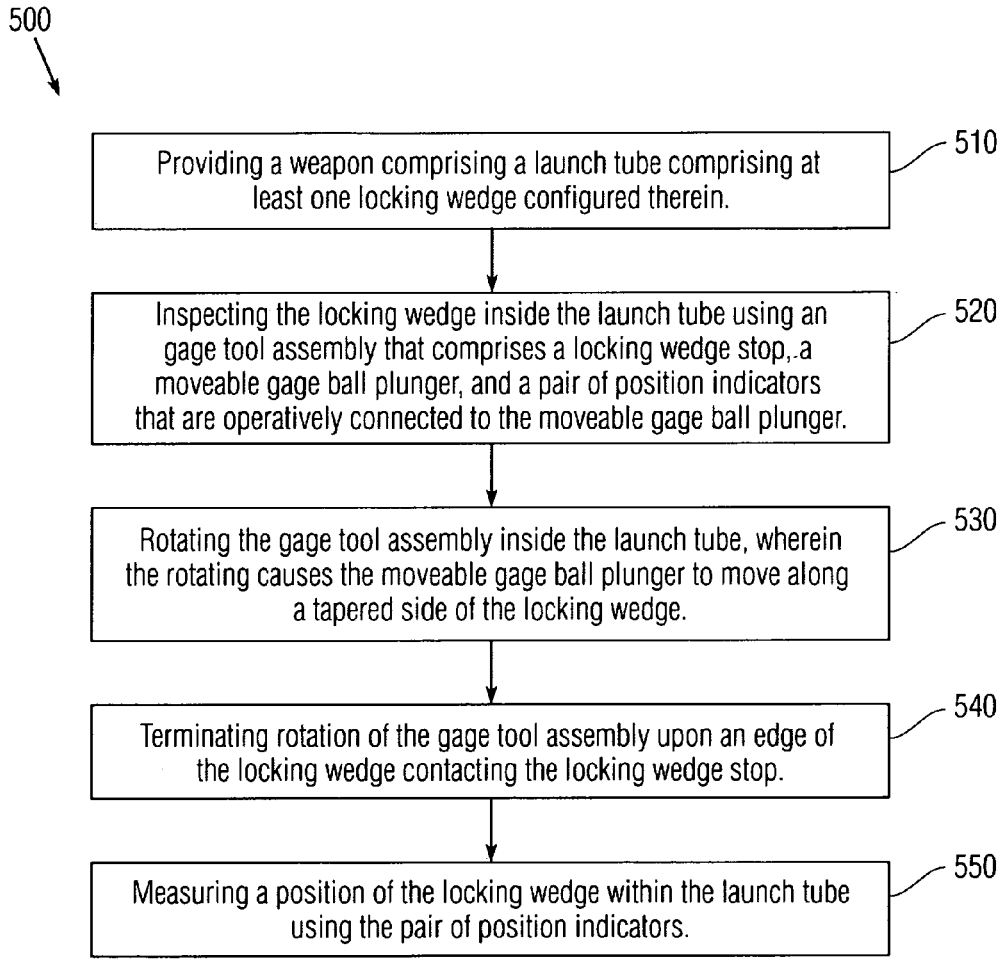
FIG. 15 is a flow diagram illustrating a method according to an embodiment herein.

FIG. 15, with reference to FIGS. 1 through 12, is a flow diagram 500 illustrating a method of inspection according to an embodiment herein, wherein the method comprises providing 510 a weapon comprising a launch tube 200 comprising at least one locking wedge 85 configured therein; inspecting 520 the locking wedge 390 inside the launch tube 200 using an gage tool assembly 100 that comprises a locking wedge stop 310, a moveable gage ball plunger 305, and a pair of position indicators 160 and 170 that are operatively connected to the moveable gage ball plunger 305; rotating 530 the gage tool assembly 100 inside the launch tube 200, wherein the rotating causes the moveable gage ball plunger 305 to move along a tapered side 410 of the locking wedge 390; terminating 540 rotation of the gage tool assembly 100 upon an edge 400 of the locking wedge 390 contacting the locking wedge stop 310; and measuring 550 a position of the locking wedge 390 within the launch tube 200 using the pair of position indicators 160 and 170.

The method may further comprise measuring the launch tube 200. The pair of position indicators 160 and 170 may comprise a first position indicator 160 and a second position indicator 170, wherein the second position indicator 170 takes measurements more precisely than the first position indicator 160. The method may further comprise interchanging a plurality of configurations of the locking wedge stop 310.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. A portable inspection system comprising:

a weapon comprising a launch tube comprising at least one locking wedge configured therein; and a locking wedge gage tool assembly that inspects a position of the locking wedge inside said launch tube, wherein said assembly comprises:

a main body portion comprising an inner core and an outer surface;

a handle operatively connected to said main body portion, wherein said handle permits rotation of said main body portion inside said launch tube;

a pair of diametrically opposed limit stop plate assemblies connected to said main body portion, wherein each limit stop plate assembly comprises an outer surface facing away from said inner core and substantially matching a contour of the outer surface of said main body portion;

an interchangeable locking wedge stop connected to said each limit stop plate assembly and configured to engage said locking wedge inside said launch tube and prevent further rotation of said main body portion inside said launch tube upon contacting said locking wedge;

a moveable gage ball plunger positioned through said each limit stop plate assembly and contacting said locking wedge; and a pair of position indicators operatively connected to said moveable gage ball plunger, wherein said pair of position indicators measure a position of said locking wedge within said launch tube.

2. The system of claim 1, further comprising an interchangeable ring configured around said main body portion.

3. The system of claim 1, wherein said pair of position indicators comprise a first position indicator and a second position indicator, wherein said second position indicator takes measurements more precisely than said first position indicator.

4. The system of claim 3, wherein said first position indicator is diametrically opposed to said second position indicator.

5. The system of claim 1, wherein said interchangeable locking wedge stop comprises a plurality of configurations, wherein a first configuration is narrower than a second configuration.

6. The system of claim 1, wherein said moveable gage ball plunger is spring actuated and moves upon contacting said locking wedge.

7. The system of claim 1, further comprising a moveable socket connected to said each limit stop plate assembly, wherein said moveable socket is operatively connected to each of said pair of position indicators and said moveable gage ball plunger.

8. The system of claim 1, wherein said each limit stop plate assembly is formed of a mechanically harder material than said main body portion.

9. A method of inspection comprising:

providing a weapon comprising a launch tube comprising at least one locking wedge configured therein;

inspecting the locking wedge inside said launch tube using an gage tool assembly that comprises a locking wedge stop, a moveable gage ball plunger, and a pair of position indicators that are operatively connected to said moveable gage ball plunger;

rotating said gage tool assembly inside said launch tube, wherein the rotating causes said moveable gage ball plunger to move along a tapered side of said locking wedge;

terminating rotation of said gage tool assembly upon an edge of said locking wedge contacting said locking wedge stop; and measuring a position of said locking wedge within said launch tube using said pair of position indicators.

10. The method of claim 9, further comprising measuring said launch tube.

11. The method of claim 9, wherein said pair of position indicators comprise a first position indicator and a second position indicator, wherein said second position indicator takes measurements more precisely than said first position indicator.

12. The method of claim 9, further comprising interchanging a plurality of configurations of said locking wedge stop.

* * * * *